US006748771B2

(12) United States Patent
Nitschmann et al.

(10) Patent No.: US 6,748,771 B2
(45) Date of Patent: Jun. 15, 2004

(54) PORTHOLE WINDOW FOR A FRONT-LOADING DRUM-TYPE WASHING MACHINE

(75) Inventors: Kai Nitschmann, Berlin (DE); Wolfgang Proppe, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/328,778

(22) Filed: Dec. 23, 2002

(65) Prior Publication Data

US 2003/0110813 A1 Jun. 19, 2003

Related U.S. Application Data

(63) Continuation of application No. PCT/EP01/07166, filed on Jun. 25, 2001.

(30) Foreign Application Priority Data

Jun. 27, 2000 (DE) ..... 100 31 171

(51) Int. Cl.[7] ..... D06F 39/14
(52) U.S. Cl. ..... 68/3 R; 68/196
(58) Field of Search ..... 68/3 R, 5 E, 24, 68/58, 104, 142, 196; 220/337

(56) References Cited

U.S. PATENT DOCUMENTS 2,376,449 A * 5/1945 Oliver ..... 220/377
4,934,559 A * 6/1990 Putnam ..... 220/377

FOREIGN PATENT DOCUMENTS

| | | | |
|---|---|---|---|
| DE | 1 083 219 | | 6/1960 |
| DE | 1460998 | * | 4/1969 |
| DE | 1 585 607 | | 5/1971 |
| DE | 90 14 622.0 U1 | | 2/1991 |
| FR | 2 439 254 A | | 5/1980 |

OTHER PUBLICATIONS

European Pat. Office 261,363 Mar. 1988.*

European Pat. Office 343,151 May 1989.*

* cited by examiner

*Primary Examiner*—Frankie L. Stinson
(74) *Attorney, Agent, or Firm*—Laurence A. Greenberg; Werner H. Stemer; Gregory L. Mayback

(57) ABSTRACT

A porthole window includes a circular base section being a viewing glass having a substantially planar inner surface and a border region, and a rigid plastic side-wall section of the bowl tapering in a direction of the base section. The viewing glass, over an entire border region of the base section, is curved in a direction of the side-wall section such that the border region of the base section forms a rounded glass shoulder. On the outer border of the glass shoulder, the viewing glass has an annular connecting section running obliquely in relation to the inner surface of the base section and, at its head end, firmly engages with the inner end of the side-wall section.

23 Claims, 2 Drawing Sheets

PORTHOLE WINDOW FOR A FRONT-LOADING DRUM-TYPE WASHING MACHINE

CROSS-REFERENCE TO RELATED APPLICATION

This application is a continuation of copending International Application No. PCT/EP01/07166, filed Jun. 25, 2001, which designated the United States and was not published in English.

BACKGROUND OF THE INVENTION

Field of the Invention

The present invention relates to a porthole window for a front-loading drum-type washing machine, the porthole window being of bowl-like shape, closed in the direction of the interior of the washing machine, and having a circular base section and a side-wall section. The base section is formed from a viewing glass having a substantially planar inner surface and a border region, and the side-wall section of the bowl, which tapers in the direction of the base section, is formed from plastic.

A porthole window is fitted on the front side of front-loading washing machines. The porthole window usually is circular and has a viewing glass as porthole window for a front-loading drum-type washing machine, which is made of transparent material, to allow the user to see into the interior of the laundry drum. When the porthole window is open, the laundry can be loaded directly into the drum and removed again. It is customary, for front-loading drum-type washing machines, to use porthole windows that are of a bowl-like shape, closed in the direction of the interior of the washing machine. This means that the porthole window fills the region between the housing casing and laundry drum. As a result, a dead space between the outside of the washing machine and the rotating laundry drum is avoided. Corresponding porthole windows for front-loading drum-type washing machines, at present, usually have a bowl-like element made of glass or a transparent plastic material. Because the porthole window directly forms the opening-side boundary of the laundry drum, it is important to provide suitable sealing between the rotating drum and the fixed parts of the machine.

A porthole window is disclosed, for example, from German Utility Model G 90 14 622 U1. The document discloses a transparent bowl-like element, which is of substantially hemispherical shape, and a surrounding frame element, which is fitted on the outer peripheral edge of the bowl-like element. The bowl-like element is, preferably, produced from glass, but may also be of a transparent plastic material.

The disadvantage with the porthole window according to German Utility Model G 90 14 622 U1 is the fact that, if transparent plastic is used, this does not give an optimum view into the laundry drum because, in particular, as a result of chemical attack and wear caused by rotating items of laundry, it becomes opaque after having been used for a relatively long period of time. Using glass for a bowl-like element is disadvantageous because it renders the porthole window relatively heavy and unwieldy.

Such a disadvantage is overcome by the prior art configuration according to German Published, Non-Prosecuted Patent Application DE 1 083 219 B. This document discloses a porthole window for drum-type washing machines that, in the region between the outside of the appliance and the laundry drum, is extended inwards, this being done by a collar that is made of soft/resilient material and on the inside, directed towards the drum, has inwardly directed sealing lips for accommodating a transparent panel.

The disadvantage with this prior art window is that the sealing lip of the soft/resilient collar, the lip being directed towards the laundry drum, may become porous, when used for a relatively long period of time, as a result of prolonged contact with the suds. Moreover, the soft/resilient sealing lip may become displaced as a result of the rotating items of laundry. When used for a relatively long period of time, in addition, serious wear of the soft/resilient sealing lip caused by the rotating items of laundry is unavoidable. These effects permanently impair the desired sealing of the laundry drum. The secure hold of the glass panel between the sealing lips may even be at risk. In addition, when part of an item of laundry comes into contact with the soft/resilient sealing lip, this part may be braked abruptly, which may result in the laundry being subjected to excessive stress and being, possibly, torn.

SUMMARY OF THE INVENTION

It is accordingly an object of the invention to provide a porthole window for a front-loading drum-type washing machine that overcomes the hereinafore-mentioned disadvantages of the heretofore-known devices of this general type and that that is relatively lightweight and easy to handle, ensures reliable sealing of the housing for the period of time over which the washing machine is used, and, in addition, avoids subjecting items of laundry to additional stress.

With the foregoing and other objects in view, there is provided, in accordance with the invention, a porthole window for a front-loading drum washing machine, including a bowl-shaped porthole window closed in a direction of an interior of the washing machine, the window having a viewing glass forming a circular base section of the window, the base section having a substantially planar inner surface and a border region, and a plastic side-wall section tapering in a direction of the base section, the side-wall section having an inner end, the plastic being of a hard/resilient material, and the viewing glass being curved in a direction of the side-wall section over an entirety of the border region to form a rounded glass shoulder from the border region, the glass shoulder having an outer border, and having an annular connecting section on the outer border of the glass shoulder running obliquely with respect to the inner surface of the base section, the connecting section having a head end firmly engaging with the inner end of the side-wall section, the inner end being disposed adjacent the base section.

According to the invention, the plastic is a hard/resilient material, the viewing glass, over the entire border region, is curved in the direction of the side-wall section such that a rounded glass shoulder is formed, and the viewing glass, on the outer border of the glass shoulder, has an annular connecting section that runs obliquely in relation to the inner surface of the viewing glass and, at its head end, firmly engages with the inner end of the side-wall section. The measures according to the invention provide a relatively lightweight porthole window that is resistant to wear and does not subject the rotating laundry to any effects of breaking or wear.

The side-wall section, that is of plastic, may be retained, in a particularly advantageous manner, with narrower tolerances than if a glass casting were used here (approximately ⅓ of the glass tolerance). This allows better control of the sealing function between the porthole window and the sealing collar that encloses the window.

In accordance with another feature of the invention, the side-wall section has an inner end with a groove, the head end has an extension running substantially parallel to the inner surface of the base section, and the extension engages the groove.

The head end of the connecting section is advantageously configured such that it has an extension for engaging with a corresponding groove in the inner end of the side-wall section. As a result, a secure connection is ensured. Preferably, the extension watertightly engages the groove.

In accordance with a further feature of the invention, the head end has an extension running initially substantially parallel to the inner surface of the base section and then substantially perpendicularly thereto.

In accordance with an added feature of the invention, the head end of the connecting section is, preferably, connected in one piece to the side-wall section by injection molding. As a result, the number of individual components is reduced, which helps to reduce assembly and storage costs.

In accordance with an additional feature of the invention, the side-wall section is injection molded plastic, and the side-wall section is connected in one piece to the glass head end.

In accordance with yet another feature of the invention, the plastic side-wall section is injection molded connected in one piece to the glass head end.

In accordance with yet a further feature of the invention, the glass head end is connected in one piece to the plastic side-wall section by injection molding the plastic side-wall section to the glass head end.

In accordance with yet an added feature of the invention, to reduce the number of components further, it is advantageously possible, in addition, for the outer end of the side-wall section to be formed in one piece as an annular door frame.

In a preferred embodiment, to increase the resistance of the glass to breaking, the inner surface of the viewing glass is curved in the direction of the bowl opening.

In accordance with yet an additional feature of the invention, the inner end is disposed in an immediate vicinity of the base section.

In accordance with again another feature of the invention, the inner end is disposed in immediately adjacent the base section.

In accordance with again a further feature of the invention, the head end watertightly engages with the inner end of the side-wall section.

With the objects of the invention in view, there is also provided a front-loading drum washing machine, including a washing container having an interior and defining an unloading opening and a bowl-shaped porthole window closed in a direction of the interior, the window being movably disposed at the unloading opening and having a viewing glass forming a circular base section of the window, the base section having a substantially planar inner surface and a border region and a plastic side-wall section tapering in a direction of the base section, the side-wall section having an inner end, the plastic being of a hard/resilient material, and the viewing glass being curved in a direction of the side-wall section over an entirety of the border region to form a rounded glass shoulder from the border region, the glass shoulder having an outer border and having an annular connecting section on the outer border of the glass shoulder running obliquely with respect to the inner surface of the base section, the connecting section having a head end firmly engaging with the inner end of the side-wall section, the inner end being disposed adjacent the base section.

Other features that are considered as characteristic for the invention are set forth in the appended claims.

Although the invention is illustrated and described herein as embodied in a porthole window for a front-loading drum-type washing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
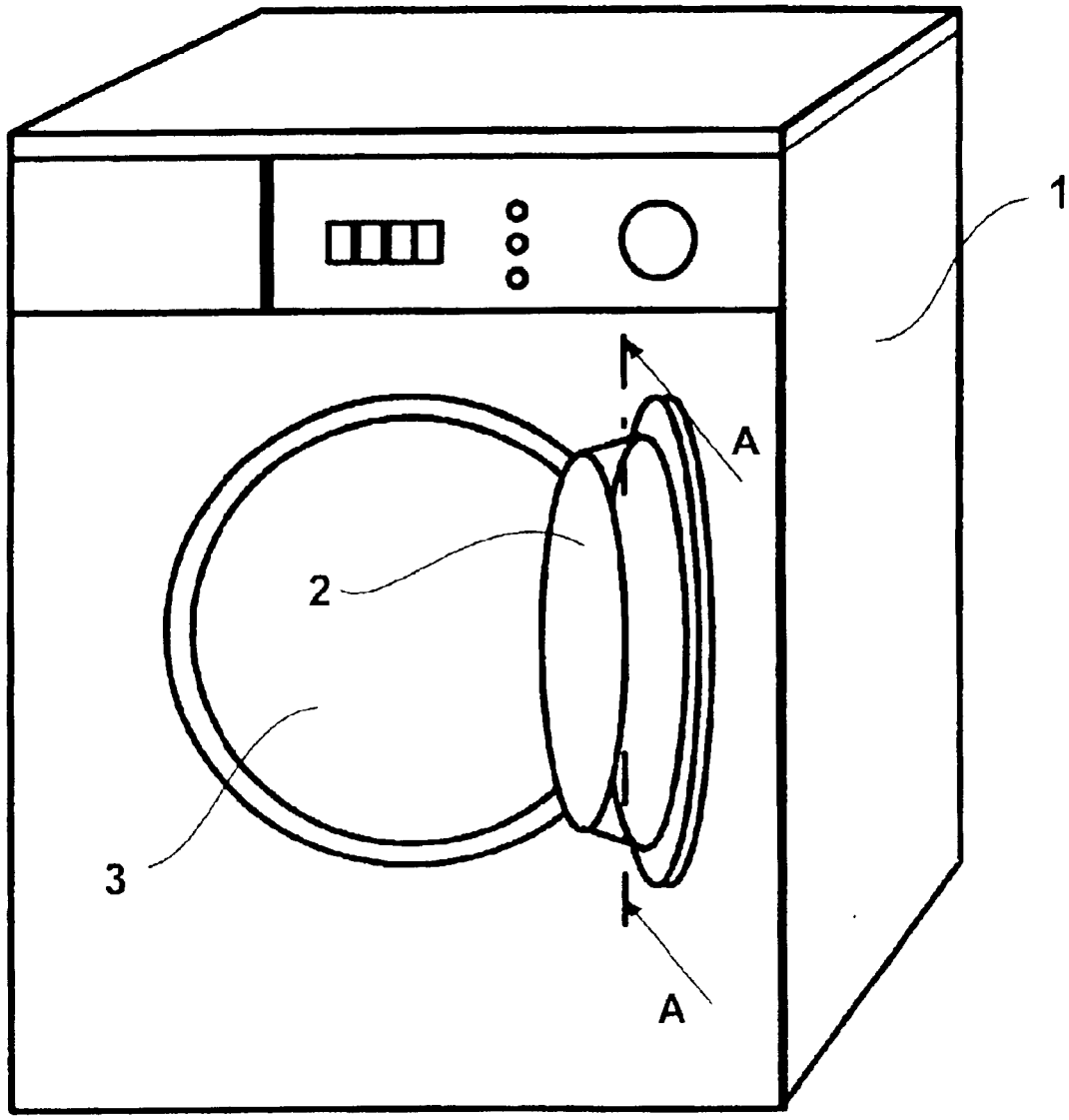
FIG. 1 is a perspective front view of a front-loading washing machine according to the invention with a porthole window in an open position.

Referring now to the figures of the drawings in detail and first, particularly to FIG. 1 thereof, there is shown a front view of a washing machine 1 with an open porthole window 2 for closing the loading and unloading opening 3.

Figure 2:
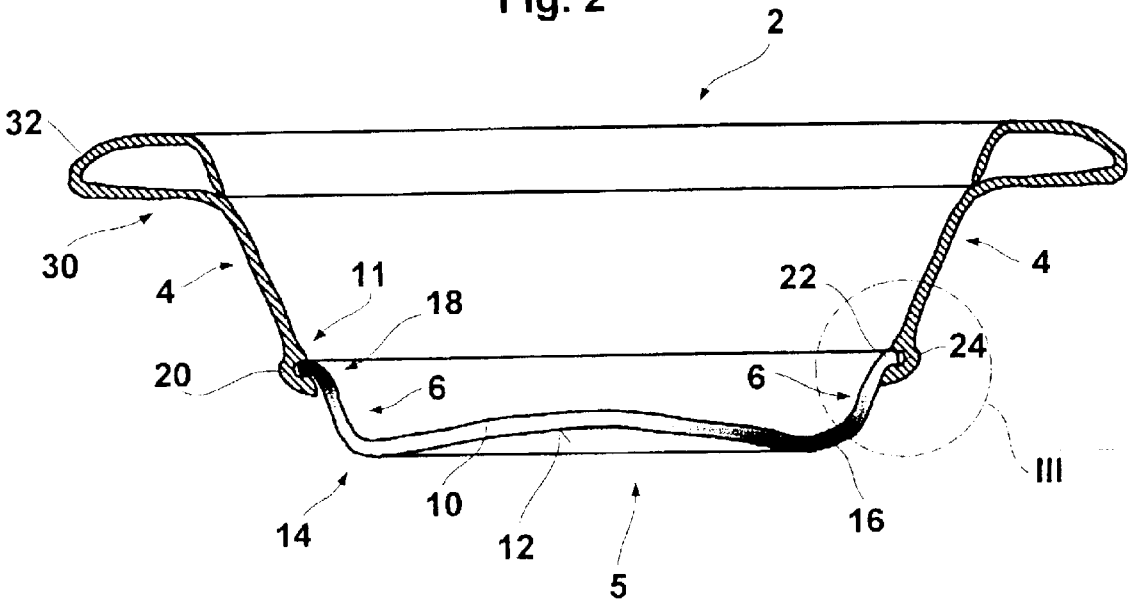
FIG. 2 is a cross-sectional view of an embodiment of the porthole window according to the invention along section line A—A in FIG. 1 with the window rotated 90°.

FIG. 2 illustrates a preferred embodiment of the porthole window 2 according to the invention. The porthole window 2 includes a side-wall section 4, which is made of rigid plastic material, and a base section 5, which is formed by a viewing glass 10 made of natural glass. The viewing glass 10 has an inner surface 12 that is curved slightly in the direction of the bowl opening. Over the border region 14 of the base section 5, the viewing glass 10 is curved in the direction of the side-wall section 4 such that a rounded glass shoulder 16 is formed. On the outer border of the glass shoulder 16, the viewing glass 10 has an annular connecting section 6 that runs obliquely in relation to the inner surface 12 of the base section 5. The connecting section 6 opens out into a head end 18, which has an annular extension 22 that runs substantially parallel to the inner surface 12 of the base section 5.

The extension 22 engages in a head end 20 of the side-wall section 4 such that it firmly engages with a correspondingly shaped groove 24 at the inner end 11 of the side-wall section 4. The connection is, preferably, produced in that the head end 18 of the preformed viewing glass 10, including the extension 22, is encapsulated in one piece by the head end 20 of the side-wall section 4 as the latter is injection molded. Alternatively, it is also possible for the plastic side-wall section 4 to be snapped onto the extension 22 of the viewing glass 10 when still hot enough to be flexible. The shape of the side-wall section 4 may be selected such that the outer end 30 of the side-wall section 4 is formed in one piece as an annular door frame 32.

Figure 3:
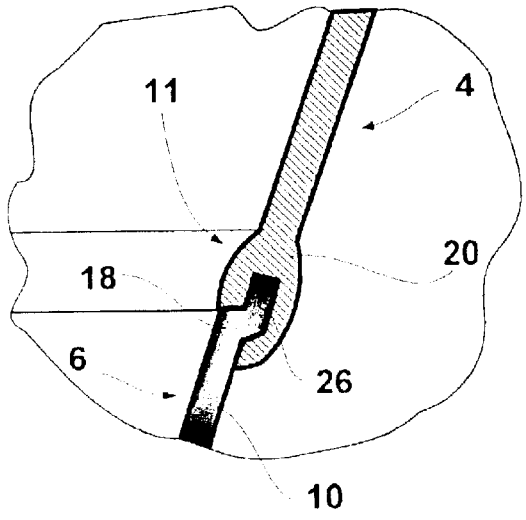
FIG. 3 is a fragmentary cross-sectional view of a detail III in FIG. 3 of a second embodiment of the porthole window according to the invention.

A second, similarly preferred embodiment of the porthole window 2 according to the invention is shown by the sectionally illustrated detail III in FIG. 3, which relates to the border section of the viewing glass 10 and of the side-wall section 4. Here, the head end 18 of the connecting section 6 of the viewing glass 10 has an annular extension 26 that runs initially substantially parallel to the inner surface 12 of the base section 5 and, then, approximately perpendicularly thereto. In such an embodiment, the glass head end 18 is encapsulated by the side-wall section 4 as the latter is injection molded. As a result, an extremely secure connection is produced.

For operation of the washing machine, the closed porthole window 2 fills the space of the charging opening between the outside of the appliance and the laundry drum. The laundry drum is, thus, bounded on its front side by the viewing glass 10 of the porthole window 2, this ensuring, at the same time, that the washing-machine user can see freely into the laundry drum. The rotation of the items of laundry does not harm the viewing glass 10 because it is of silicate glass. The rotating laundry is not harmed by the contact between it and the silicate glass because the rounded glass shoulder 16 has a smooth and gentle structure.

In addition to the two embodiments that are described in preference, other geometrical shapes of the viewing glass 10, in particular, of the head end 18 thereof, are also conceivable, e.g., the encapsulated extension 22, 26 may be T-shaped.

We claim:

1. A porthole window for a front-loading drum washing machine, comprising:

a bowl-shaped porthole window closed in a direction of an interior of the washing machine, said window having:

a viewing glass forming a circular base section of said window, said base section having a substantially planar inner surface and a border region; and a plastic side-wall section tapering in a direction of said base section, said side-wall section having an inner end, said plastic being of a hard/resilient material; and said viewing glass:

being curved in a direction of said side-wall section over an entirety of said border region to form a rounded glass shoulder from said border region, said glass shoulder having an outer border; and having an annular connecting section on said outer border of said glass shoulder running obliquely with respect to said inner surface of said base section, said connecting section having a head end firmly engaging with said inner end of said side-wall section, said inner end being disposed adjacent said base section.

2. The porthole window according to claim 1, wherein:

said side-wall section has an inner end with a groove;

said head end has an extension running substantially parallel to said inner surface of said base section; and said extension engages said groove.

3. The porthole window according to claim 2, wherein:

said groove and said extension are correspondingly shaped; and said extension watertightly engages said groove.

4. The porthole window according to claim 1, wherein said head end has an extension running initially substantially parallel to said inner surface of said base section and then substantially perpendicularly thereto.

5. The porthole window according to claim 1, wherein:

said side-wall section is injection molded plastic; and said side-wall section is connected in one piece to said glass head end.

6. The porthole window according to claim 1, wherein said plastic side-wall section is injection molded connected in one piece to said glass head end.

7. The porthole window according to claim 1, wherein said glass head end is connected in one piece to said plastic side-wall section by injection molding said plastic side-wall section to said glass head end.

8. The porthole window according to claim 1, wherein:

said side-wall section has an outer end; and said outer end is formed in one piece as an annular door frame.

9. The porthole window according to claim 1, wherein said side-wall section has a one-piece outer end forming an annular door frame.

10. The porthole window according to claim 1, wherein:

said bowl-shaped porthole window has a bowl opening; and said inner surface of said viewing glass is curved in a direction of said bowl opening.

11. The porthole window according to claim 1, wherein said inner end is disposed in an immediate vicinity of said base section.

12. The porthole window according to claim 1, wherein said inner end is disposed in immediately adjacent said base section.

13. The porthole window according to claim 1, wherein said head end watertightly engages with said inner end of said side-wall section.

14. A front-loading drum washing machine, comprising:

a washing container having an interior and defining an unloading opening;

a bowl-shaped porthole window closed in a direction of said interior, said window being movably disposed at said unloading opening and having:

a viewing glass forming a circular base section of said window, said base section having a substantially planar inner surface and a border region; and a plastic side-wall section tapering in a direction of said base section, said side-wall section having an inner end, said plastic being of a hard/resilient material; and said viewing glass:

being curved in a direction of said side-wall section over an entirety of said border region to form a rounded glass shoulder from said border region, said glass shoulder having an outer border; and having an annular connecting section on said outer border of said glass shoulder running obliquely with respect to said inner surface of said base section, said connecting section having a head end firmly engaging with said inner end of said side-wall section, said inner end being disposed adjacent said base section.

15. The porthole window according to claim 14, wherein:

said side-wall section has an inner end with a groove;

said head end has an extension running substantially parallel to said inner surface of said base section;

said groove and said extension are correspondingly shaped; and said extension watertightly engages said groove.

16. The porthole window according to claim 14, wherein said head end has an extension running initially substantially parallel to said inner surface of said base section and then substantially perpendicularly thereto.

17. The porthole window according to claim 14, wherein:

said side-wall section is injection molded plastic; and said side-wall section is connected in one piece to said glass head end.

18. The porthole window according to claim 14, wherein said plastic side-wall section is injection molded connected in one piece to said glass head end.

19. The porthole window according to claim 14, wherein said side-wall section has a one-piece outer end forming an annular door frame.

20. The porthole window according to claim 14, wherein:

said bowl-shaped porthole window has a bowl opening; and said inner surface of said viewing glass is curved in a direction of said bowl opening.

21. The porthole window according to claim 14, wherein said inner end is disposed in an immediate vicinity of said base section.

22. The porthole window according to claim 14, wherein said inner end is disposed in immediately adjacent said base section.

23. The porthole window according to claim 14, wherein said head end watertightly engages with said inner end of said side-wall section.

* * * * *